United States Patent [19]

Dahm

[11] 3,957,066

[45] May 18, 1976

[54] COSMETIC STICK

[76] Inventor: Klaus-Peter Dahm, Stettiner Strasse, Rethen, Germany, 3011

[22] Filed: Jan. 9, 1975

[21] Appl. No.: 539,735

[52] U.S. Cl. ..... 132/88.7; 401/122

[51] Int. Cl.[2] ..... A45D 40/26

[58] Field of Search ..... 132/88.7, 88.5, 7; 401/122, 130; 15/257.05; 424/87.1, 71, 72

[56] References Cited

UNITED STATES PATENTS

| | | | |
|---|---|---|---|
| 1,962,875 | 6/1934 | Reber | 401/130 |
| 2,627,619 | 2/1953 | Gagen | 401/122 |
| 3,078,856 | 2/1963 | Bender et al. | 132/93 |
| 3,144,391 | 8/1964 | Goff | 167/87.1 |
| 3,262,461 | 7/1966 | Kambersky | 401/122 |
| 3,298,054 | 1/1967 | Humble et al. | 401/122 |
| 3,372,424 | 3/1968 | Kellett | 15/257.05 |
| 3,630,211 | 12/1971 | Seidler | 132/88.5 |

*Primary Examiner*—G. E. McNeill
*Attorney, Agent, or Firm*—V. Alexander Scher

[57] ABSTRACT

A cosmetic stick for applying colouring matter to the skin comprises a rigid pencil shaped carrier for a cylindrical applicator which consists of a piece of soft plastics foam with a storage capacity for one application of colourant.

1 Claim, 3 Drawing Figures

COSMETIC STICK

The invention concerns a cosmetic stick with a rigid, pencil shaped carrier to which an almost cylindrically shaped applicator is fitted which serves to apply a liquid colourant from the container of the stick to the skin of the user. This invention is particularly suitable for the use as an eye shadow applicator, for applying a colourant to the eyelid.

The method of applying colouring matter to the skin with a brush or spatula and then distributing or rubbing it in with a finger, is generally known. This method does not permit correct measuring of the colouring matter, which can easily be spilled on application. Also known are fatbased cosmetic sticks in the form of pencils, which have to be applied to the skin with more pressure and have to be sharpened frequently. Some cosmetic sticks have a capillary applicator which is fitted with a liquid in which a colouring matter is dissolved. Such sticks never gained popularity, because liquids containing dissolved colouring matter penetrate into skin when applied and are difficult to remove, making them therefore unsuitable for cosmetic purposes. The method of applying a powder or liquid colourant by means of an applicator consisting of several spongy parts and a rigid support is also known. Again it is impossible to obtain a correct measure of the colourant and there is no means of wiping off any surplus colouring matter or preventing dripping from the applicator.

It is the object of this invention to provide a simple cosmetic applicator, in particular an eye shadow applicator, such that it eliminates all previously mentioned disadvantages and allows a quick, measured and clean application of a liquid colourant to the skin.

According to this invention the applicator consists of a piece of soft, cellular plastics foam with a safe storing capacity of a measured amount of colourant. Preferably one should use a Polyether plastics foam with a volumetric weight of 30–60 kg/m$^3$, which is cellular and capable of storing the colouring matter.

An applicator made in one piece from such a soft, cellular plastics foam ensures, even over a longer period of time, a functional use of the applicator, conditioned by the fact that the plastics foam, because of its cellular structure and its chemical nature, does not cause a reaction with the colourant matter and has a negligably small swelling property. Such a soft plastics foam also enables a gentle application of the colourant to the skin.

Another feature of this invention is that the applicator is capable of leakproof storage of colourant sufficient for one application. Suitably the applicator should have a length of up to approximately 30 mm, preferably about 20 mm, an external diameter of about 6 mm and an internal diameter of about 2 mm. An applicator of such dimensions has a storing capacity for a colourant sufficient for one application.

The pencil shaped carrier for the applicator is fastened to a cap that closes the colourant container and is suitably shaped so that that part of the carrier that is fastened to the locking cap has a larger diameter than that of the applicator. Consequently the applicator, when saturated with the liquid colourant, does not on withdrawing touch the walls of the colourant container, and the colour is not allowed to accumulate and cannot soil the fingers of the user.

In order to fasten the soft applicator safely to the pencil shaped carrier, it is recommended that the carrier should be provided with knurls or projections with which the applicator can be held safely on the carrier.

It is recommended that the upper end of the colourant container should be provided with a wiping device which allows a return flow of the wiped off surplus colourant from the applicator and that part which touches the applicator should consist of a flexible material. Such an arrangement avoids any undesirable leakage of colourant from the colourant container or withdrawal of the applicator.

A dispersion of an insoluble colour in a carrier liquid is most suited as the colourant.

In a further development of this invention an economical way of manufacturing the applicator can be achieved by cutting or milling a sheet of plastics foam into strands to the width of the external diameter of the applicator. This strand can then be cut to the size of the individual applicators, ready to be provided with a cylindrical cavity for the fastening to the pencil shaped carrier. This cylindrical cavity of the applicator can be achieved for instance by introducing heated, pencil shaped studs into the strands.

The invention will be explained in detail by way of example with reference to the following drawings, in which.

Figure 1:
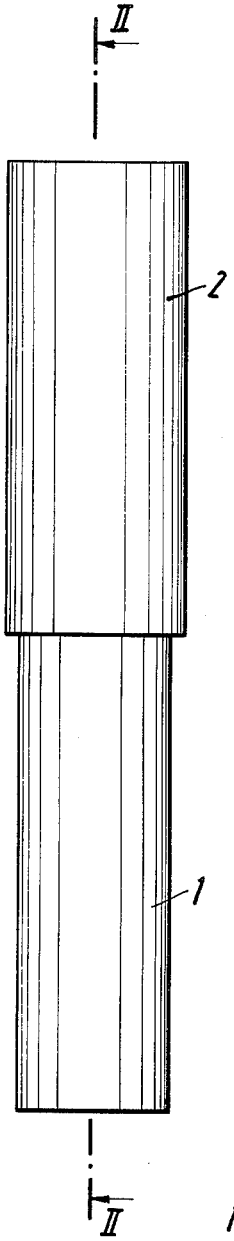
FIG. 1 shows an embodiment of the invention in a closed position.
Figure 2:
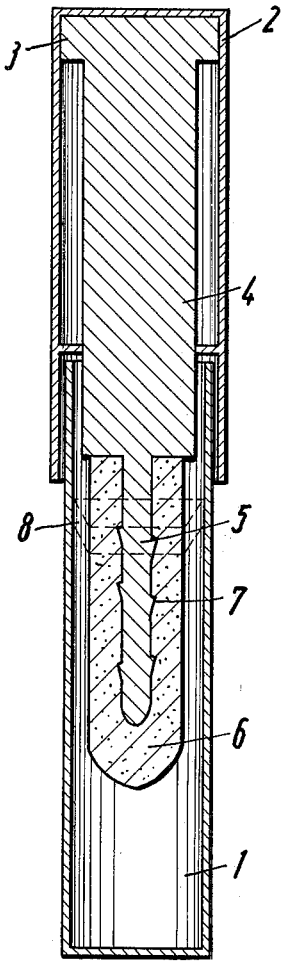
FIG. 2 shows a longitudinal cross section of the plane II—II of FIG. 1.

The cosmetic stick, for instance an eye shadow applicator, consists of a cylindrical colourant container 1, made of transparent or coloured plastics and has either a slip-on or screw-on cap 2. The cap 2 is provided with a plate 3 and a cylindrical shaft 4 which extends into a rigid, pencil shaped carrier 5 for the fitting of an applicator 6. The applicator 6 consists of one piece of cylindrically shaped, soft, cellular plastics foam, preferably a polyether plastics. The pencil shaped carrier 5 is provided with projections 7 to hold the applicator 6. The shaft 4 has a larger diameter than the applicator 6, so that on withdrawal from the colourant container 1 the applicator 6 will not touch the side walls.

Figure 3:
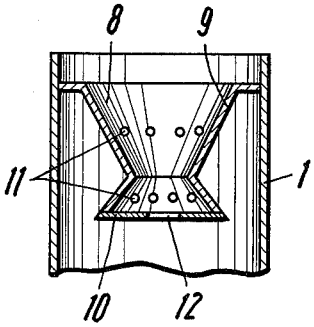
FIG. 3 shows one detail in enlarged scale.

At the upper end of the colourant container 1 is a wiping device 8 which is illustrated in FIG. 3 on an enlarged scale.

As shown in FIG. 3, the upper end of the colourant container 1 is provided with a rigid, double cone shaped support 9 to which a flexible, lipped wiper 10 is fitted, possibly consisting of rubber. The support 9 could be manufactured of hard plastics and would be provided with two rows of discharge openings 11 through which any surplus colourant, on withdrawing the applicator, can return to the colourant container. The centre opening 12 of the wiper 10 has a slightly smaller diameter than the external diameter of the applicator 6, so that the wiper 10 lies like a skin against the applicator and wipes off any surplus colourant matter when withdrawn from the colourant container ready for use.

In order to give the applicator 6 a storing capacity of colourant sufficient for one application, it should be approximately 20 mm long, have an external diameter of about 2 mm. This storage capacity of the applicator ensures a clean, spillproof application of the colourant to the skin and in particular to the eyelid.

The colourant preferably consists of a dispersed colour in a carrier liquid adaptable to the physical properties of the chosen plastics foam of the applicator 6. The colourant should not be of too high a viscosity and surface tension. The colourant could for instance have the following composition:

| | |
|---|---|
| Colour | 10–25% |
| Dihydric alcohol | 10–25% |
| Polyhydric alcohol (3 or 4 OH- groups per molecule) | 5–15% |
| Wetting agent | 1–5% |
| Bonding agent | 1–5% |
| Suspended matter | 0.1–1% |
| Preservative | 0.1–0.5% |
| Rest distilled water | |

In order that the applicator can absorb the colourant readily, it is recommended to treat it with a wetting agent first, as for instance with Polyoxyethelene-Tridecyl-Ether-Alcohol. Since this wetting agent is also contained in the carrier agent of the colourant, the absorption power of the applicator for the colourant remains constant, even after prolonged use.

I claim:

1. A cosmetic stick, comprising a rigid cylindrical container for a liquid colorant, a cap closing said container, an inner shaft extending into said container and having an end connected with said cap, a pencil-shaped carrier connected with the other end of said shaft, an applicator enclosing said carrier and consisting of plastic foam with open cells for receiving and storing the liquid colorant, said carrier having upon its outer surfaces projections engaging said applicator, the outer diameter of said applicator being smaller than that of said shaft, a wiper located within said container and having elastic lips, including an elastic lip enclosing said applicator and having a central opening with a diameter smaller than the outer diameter of the applicator and adapted to transmit an amount of liquid colorant contained in the applicator and suitable for a single use, and a support connected with said wiper and said container and having an angular edge portion surrounding said shaft and having discharge openings, said edge portion constituting a wiping surface.

* * * * *